US010899419B2

(12) United States Patent
Hargis

(10) Patent No.: US 10,899,419 B2
(45) Date of Patent: Jan. 26, 2021

(54) SAFETY TETHER AND RELATED METHODS

(71) Applicant: Rob's Super Safe Surf Ropes, LLC, West Jordan, UT (US)

(72) Inventor: Robbie Hargis, West Jordan, UT (US)

(73) Assignee: Rob's Super Safe Surf Ropes, LLC, West Jordan, UT (US)

( * ) Notice: Subject to any disclaimer, the term of this patent is extended or adjusted under 35 U.S.C. 154(b) by 0 days.

(21) Appl. No.: 16/702,140

(22) Filed: Dec. 3, 2019

(65) Prior Publication Data

US 2020/0391833 A1 Dec. 17, 2020

Related U.S. Application Data

(60) Provisional application No. 62/860,575, filed on Jun. 12, 2019, provisional application No. 62/823,750, filed on Mar. 26, 2019.

(51) Int. Cl.

| | |
|---|---|
| ***B63B 34/60*** | (2020.01) |
| ***B63B 21/00*** | (2006.01) |
| ***B63B 21/04*** | (2006.01) |

(52) U.S. Cl.

CPC ..... *B63B 34/60* (2020.02); *B63B 21/00* (2013.01); *B63B 21/04* (2013.01)

(58) Field of Classification Search

CPC ..... B63B 21/00; B63B 21/04; B63B 21/22; B63B 21/56; B63B 34/00; B63B 34/60; B63B 35/00; B63B 35/85; A63C 11/00; A63C 11/10

USPC ..... 114/253; 441/69

See application file for complete search history.

(56) References Cited

U.S. PATENT DOCUMENTS

| | | | | |
|---|---|---|---|---|
| 3,353,817 | A * | 11/1967 | Bollinger | F16G 11/12 114/253 |
| 4,958,583 | A | 9/1990 | Renouard | |
| 6,390,009 | B2 | 5/2002 | Brown et al. | |
| 7,025,644 | B2 | 4/2006 | Geier et al. | |
| 8,448,608 | B2 | 5/2013 | Mucerino et al. | |
| 2006/0185571 | A1 | 8/2006 | Leseberg | |

FOREIGN PATENT DOCUMENTS

| | | |
|---|---|---|
| DE | 202015000274 UI | 6/2015 |

* cited by examiner

*Primary Examiner* — Lars A Olson
(74) *Attorney, Agent, or Firm* — Jason Jones

(57) ABSTRACT

A safety tether for providing a user with a connection to a vehicle includes a substantially rigid, elongate handle graspable by the user and a flexible line extending from one end of the handle and being attachable to a vehicle. An opposing end of the handle is free to move relative to the flexible line. The flexible line is elastically extendible from a relaxed configuration having a relaxed length to a taut configuration having a taut length, the taut length being greater than the relaxed length.

21 Claims, 5 Drawing Sheets

SAFETY TETHER AND RELATED METHODS

PRIORITY CLAIM

Priority is claimed of and to U.S. Provisional Patent Application Ser. No. 62/823,750, filed Mar. 26, 2019, and U.S. Provisional Patent Application Ser. No. 62/860,575, filed Jun. 12, 2019, each of which is hereby incorporated herein by reference in its entirety.

BACKGROUND OF THE INVENTION

Field of the Invention

The present invention relates generally to tethers used to secure a user or participant to a structure or vehicle. In some cases, the tether is grasped by the user and the user becomes free from attachment to the structure or vehicle by releasing his or her grip on the tether. In one particular embodiment, the invention relates to a safety tether carried by a watercraft, the safety tether capable of being grasped by a user to maintain the user in selective engagement with the watercraft.

Related Art

Many athletic, recreational, construction and industrial applications require a user to be engaged with a structure or a vehicle via a tether or strap. In some cases, an application requires such tethers to be temporarily grasped by, or attached to, a user with the intention of at some point releasing the connection between the user and the structure or vehicle. For example, some structures are temporarily held in position by users tethered to the structure and at some point in an operation, the users will release the tethers, thereby untethering the structures relative to the users. In some watersports, such as wake surfing, a surfer will temporarily grasp a tether secured to a watercraft until the surfer is in a desired position; at this point, the surfer will release the tether and surf the wake of the watercraft without remaining tethered to the watercraft.

SUMMARY OF THE INVENTION

In accordance with one aspect of the technology, a safety tether is provided to provide a user with a connection to a vehicle. The tether can include a substantially rigid, elongate handle graspable by the user. A flexible line can extend from one end of the handle and can be attached to a vehicle. An opposing end of the handle can be free to move relative to the flexible line. The flexible line can be elastically extendible from a relaxed configuration having a relaxed length to a taut configuration having a taut length, the taut length being greater than the relaxed length.

In accordance with another aspect of the invention, a safety tether is provided to provide a user with a connection to a vehicle. The tether can include a handle, graspable by a user, and a flexible line extending from the handle. The flexible line can be coupleable to a vehicle in a location remote from the handle. The flexible line can be elastically extendible from a relaxed configuration to a taut configuration and can include at least one elastic member and at least one limiter. The limiter can be operable to limit extension of the flexible line once in the taut configuration. The elastic member and the limiter can be adjustably coupled to one another to allow a user to adjust a restoring force in the tether when the tether is extended into the taut configuration.

In accordance with another aspect, a method is provided for providing a user with a connection to a vehicle. The method can include obtaining a tether including a handle graspable by a user and a flexible line extending from the handle, the flexible line being elastically extendible from a relaxed configuration having a relaxed length to a taut configuration having a taut length, the taut length being greater than the relaxed length. The tether can be coupled to the vehicle at a location along the tether such that: when the tether is in the taut condition the handle is positioned in a grasping location remote from the vehicle for grasping by the user; and when the tether is in the relaxed configuration the tether does not extend beyond a safety boundary of the vehicle.

Additional features and advantages of the invention will be apparent from the detailed description which follows, taken in conjunction with the accompanying drawings, which together illustrate, by way of example, features of the invention.

BRIEF DESCRIPTION OF THE DRAWINGS

The following drawings illustrate exemplary embodiments for carrying out the invention. Like reference numerals refer to like parts in different views or embodiments of the present invention in the drawings.

DETAILED DESCRIPTION

Figure 1:
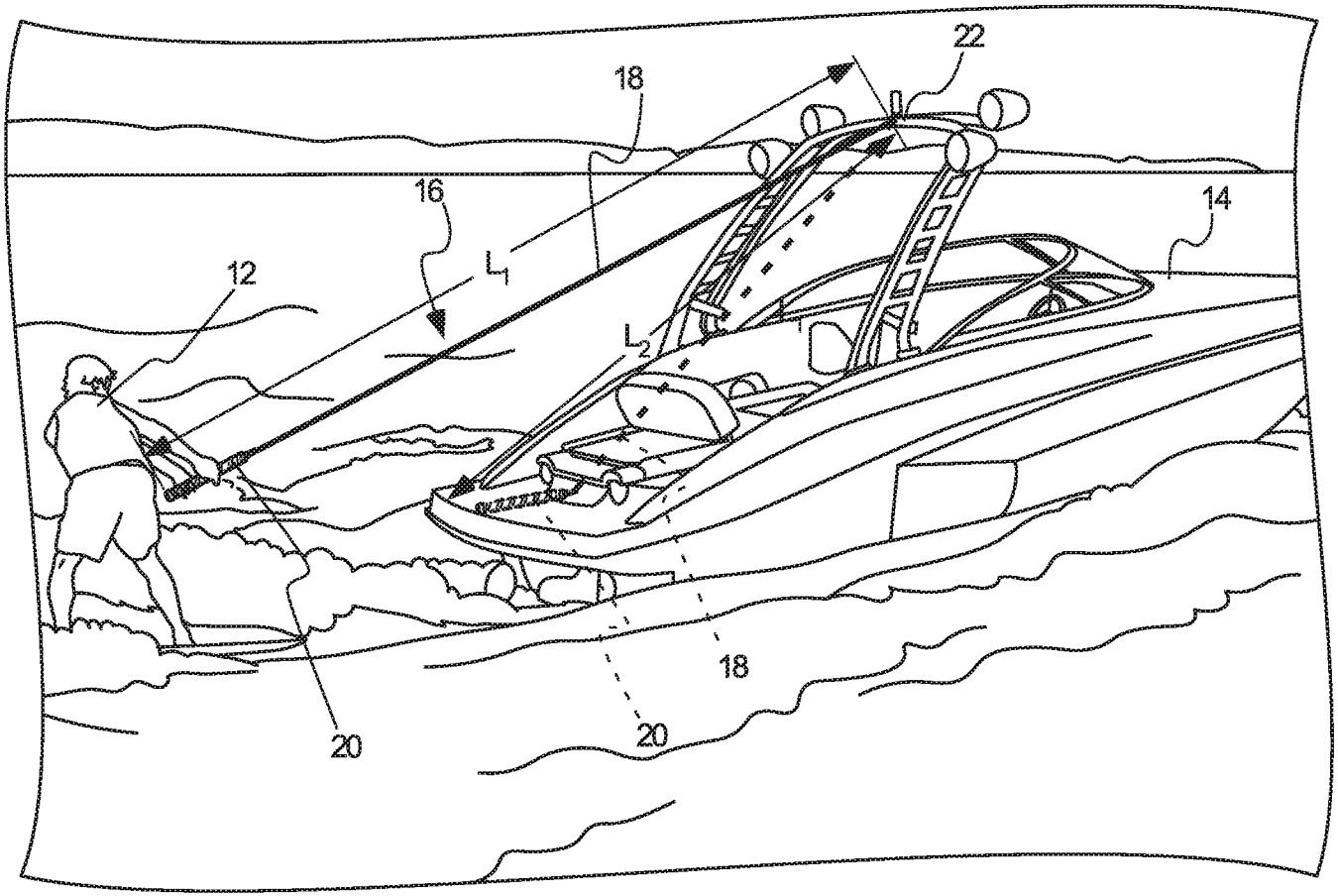
FIG. 1 is a perspective view of a wake surfer and a watercraft carrying a safety tether. The safety tether is shown in both an extended configuration, with the wake surfer grasping the tether; and in dashed lines in a relaxed configuration, stored upon the watercraft.

Reference will now be made to the exemplary embodiments illustrated in the drawings, and specific language will be used herein to describe the same. It will nevertheless be understood that no limitation of the scope of the invention is thereby intended. Alterations and further modifications of the inventive features illustrated herein, and additional applications of the principles of the inventions as illustrated herein, which would occur to one skilled in the relevant art and having possession of this disclosure, are to be considered within the scope of the invention.

Definitions

As used herein, the singular forms "a" and "the" can include plural referents unless the context clearly dictates otherwise. Thus, for example, reference to "an end" can include one or more of such ends, if the context so dictates.

As used herein, the term "substantially" refers to the complete or nearly complete extent or degree of an action, characteristic, property, state, structure, item, or result. As an arbitrary example, an object that is "substantially" enclosed is an article that is either completely enclosed or nearly completely enclosed. The exact allowable degree of deviation from absolute completeness may in some cases depend upon the specific context. However, generally speaking the nearness of completion will be so as to have the same overall result as if absolute and total completion were obtained. The use of "substantially" is equally applicable when used in a negative connotation to refer to the complete or near complete lack of an action, characteristic, property, state, structure, item, or result. As another arbitrary example, a composition that is "substantially free of" an ingredient or element may still actually contain such item so long as there is no measurable effect as a result thereof.

As used herein, the term "about" is used to provide flexibility to a numerical range endpoint by providing that a given value may be "a little above" or "a little below" the endpoint.

Relative directional terms can sometimes be used herein to describe and claim various components of the present invention. Such terms include, without limitation, "upward," "downward," "horizontal," "vertical," "proximal," "distal," etc. These terms are generally not intended to be limiting, but are used to most clearly describe and claim the various features of the invention. Where such terms must carry some limitation, they are intended to be limited to usage commonly known and understood by those of ordinary skill in the art in the context of this disclosure.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

Numerical data may be expressed or presented herein in a range format. It is to be understood that such a range format is used merely for convenience and brevity and thus should be interpreted flexibly to include not only the numerical values explicitly recited as the limits of the range, but also to include all the individual numerical values or sub-ranges encompassed within that range as if each numerical value and sub-range is explicitly recited. As an illustration, a numerical range of "about 1 to about 5" should be interpreted to include not only the explicitly recited values of about 1 to about 5, but also include individual values and sub-ranges within the indicated range. Thus, included in this numerical range are individual values such as 2, 3, and 4 and sub-ranges such as from 1-3, from 2-4, and from 3-5, etc., as well as 1, 2, 3, 4, and 5, individually.

This same principle applies to ranges reciting only one numerical value as a minimum or a maximum. Furthermore, such an interpretation should apply regardless of the breadth of the range or the characteristics being described.

INVENTION

The present technology relates generally to tethers or similar securements that can be used to attach a user to a structure or vehicle. The manner of attaching the user to the tether can include selectively attaching the user to the structure: in this manner, the user can disengage the attachment by simply releasing his or her grasp on the tether. Thus, while reference is made herein to "attaching" or "tethering" a user to some structure or vessel, it is understood that the user may in some embodiments actively participate in such attachment by grasping or holding the tether in his or her hand. Thus, in the discussion to follow, if a user is grasping a handle of a tether with his or hand, and the tether is coupled to a vehicle, the user is considered to be connected or attached to the vehicle.

The tethers discussed herein serve at least two purposes: they provide a user with attachment to a structure; and, after the user is disengaged from the tether (in some cases by releasing his or her grasp on the tether), the tether is propelled toward the structure, away from an immediate vicinity of the user. In this manner, the user is not endangered by having the tether remain in the area in which he or she is working, recreating, etc.

In one particular application, the tethers of the present technology have proven particularly effective as wake surfing tethers. Wake surfing is somewhat analogous to conventional water skiing in that that a user surfs behind a watercraft, such as a boat. However, in a conventional water skiing arrangement, the skier maintains a constant grip on a tow rope, to allow the boat to pull the skier behind it. In a typical wake surfing arrangement, however, the surfer is propelled forward by the wake of the boat—he or she is not tethered to the boat while actively surfing.

In the conventional arrangement, a wake surfer grasps a tow rope that is attached to the boat until the surfer can properly position him- or herself at the wake of the boat. Once so positioned, the surfer releases the rope and surfs without attachment to the boat. While this system functions in supporting the surfer until he or she is properly positioned, a conventional tow rope can remain in proximity with the surfer after it is released. In too many instances, the surfer has become tangled with the tow rope while surfing and has been seriously injured or killed as a result of the tow rope wrapping about the surfer and dragging the surfer through the water.

The present technology addresses this and other problems by providing a tow rope that is automatically returned to a safe zone on or around the boat after being released by the surfer. FIG. 1 illustrates one exemplary application where a wake surfer 12 is positioned behind a boat 14. The surfer is shown grasping a tether or rope 16 that is attached to the boat 14 in a conventional manner. In the example shown, the tether is attached to the boat via a tower 22. However, the tether can be connected to the boat in a variety of other, suitable locations. The tether can include a flexible line portion 18 and a handle 20.

At the time shown, the surfer 12 has positioned himself in the proper location behind the boat in which to wake surf. At this location, the tether has been extended into a taut configuration having a taut length $L_1$. This taut length is the maximum extension of the tether: the tether is fully extended and is carrying all of the force required to pull the surfer behind the boat. Once the surfer is properly positioned, he can release his grasp on the handle 20 of the tether and begin to wake surf. After this point, the surfer no longer engages the tether.

When the tether is held in the taut configuration, a restoring force is stored in the tether. As soon as the tension in the tether is released (that is, as soon as the surfer releases the handle), the restoring force returns the tether to a relaxed configuration having a length $L_2$. The taut length is generally much longer than the relaxed length. The tether is shown in the relaxed configuration in FIG. 1 in dashed lines, partially lying on the deck of the boat.

As is well known, wake surfing boats are configured to create a surfable wake behind the boat. Each wake surfing boat or watercraft will be configured differently and may require a different optimal location, behind the boat, for wake surfing. For some boats, this is generally about seven feet behind the boat. The present tether can be attached to the boat such that when the tether is extended into the taut length, the handle 20 is positioned so as to position the surfer at precisely at the optimal surfing location behind the boat. This taut length can be established or adjusted by altering the location along the flexible line 18 at which the tether is secured to the boat (e.g., at location 22).

Thus, once properly configured, the tether 16 provides a manner by which a wake surfer can safely position herself in an optimal surfing location behind the boat 14.

Thus, the maximum length of the tether can be adjusted. In addition, the present technology provides a manner in which the restoring force in the tether, when at the taut length, can be adjusted. In this manner, the force with which the tether handle travels to return to the relaxed configuration can also be adjusted. This adjustability can be provided in a number of ways. One particular configuration of an adjustable tether is shown in the remaining figures.

Figure 2:
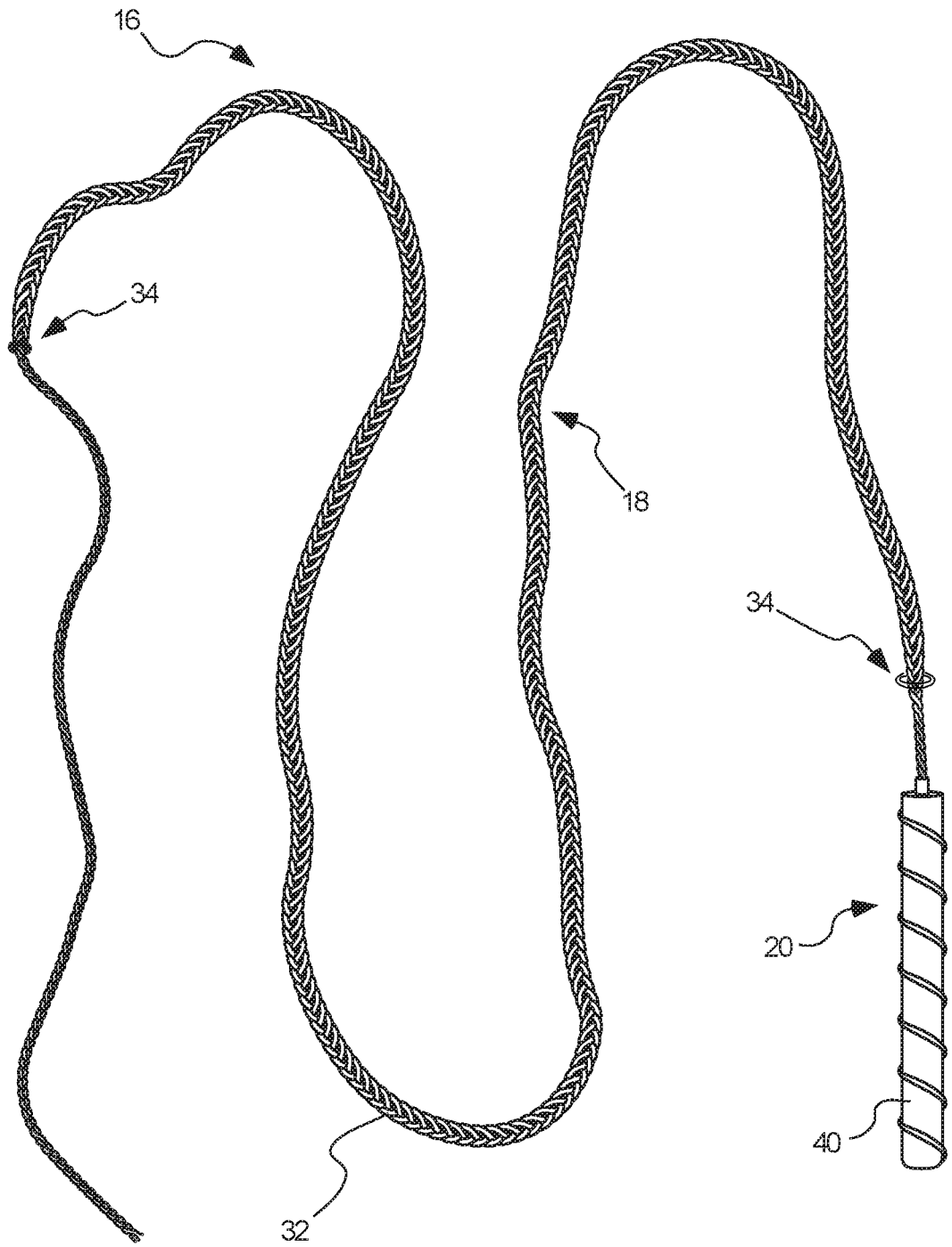
FIG. 2 is a plan view of the safety tether of FIG. 1, shown in a relaxed, partially coiled configuration.
Figure 3:
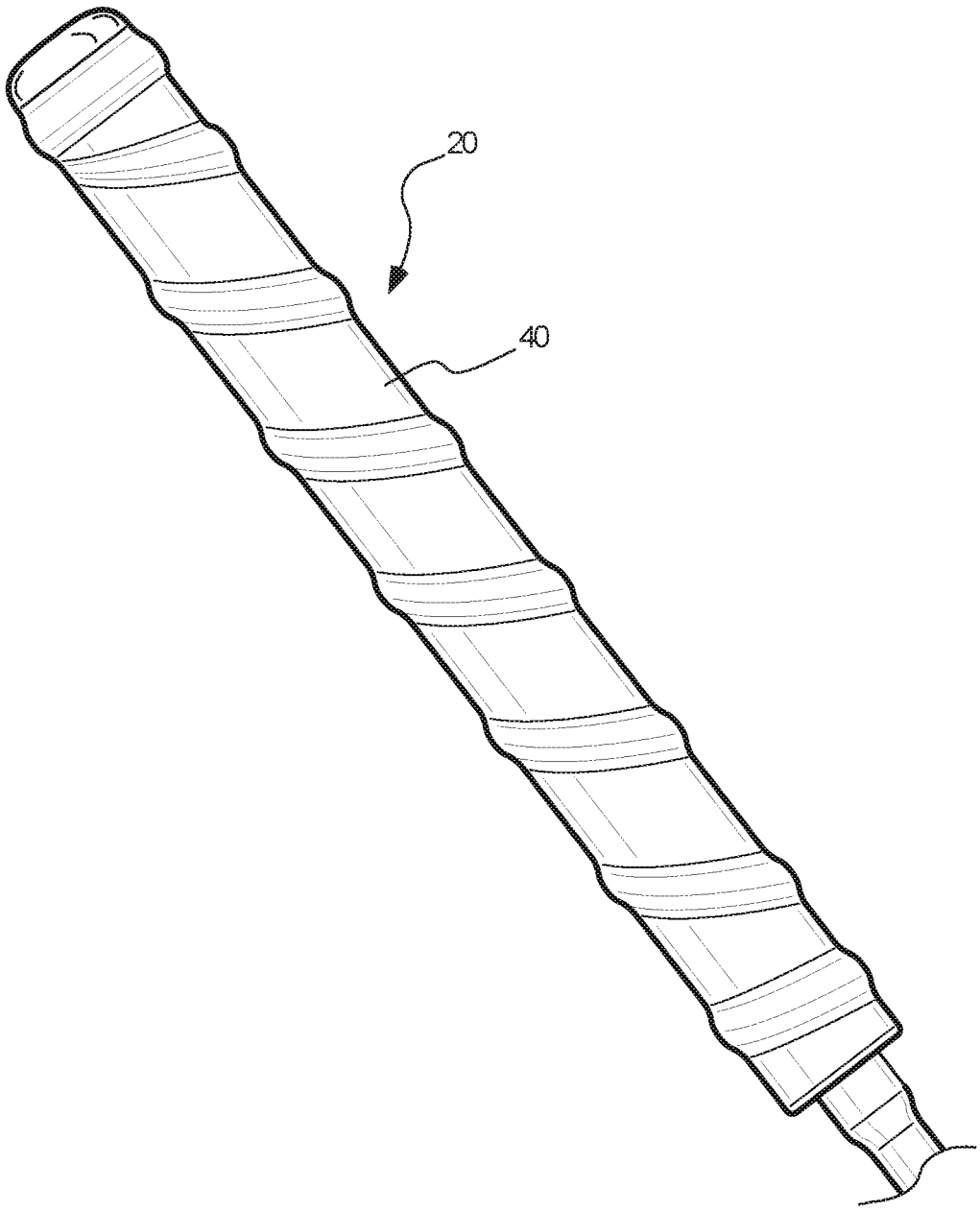
FIG. 3 is a more detailed, plan view of a handle of the safety tether.

FIG. 2 shows an exemplary tether 16 shown in a relaxed configuration. The tether includes a flexible line, in the example shown this includes a %-inch hollow-braid polypropylene rope. A handle 20 can be securely attached to the rope in a variety of manners, one of which is discussed in more detail below in connection with FIG. 7. The handle can include an outer layer of compressible foam 40, for example a 25-lb. flexible polyurethane foam, that can provide a relatively soft interface for the user. The outer foam layer can also protect the watercraft, and people on the watercraft, from injury if the handle returns to the boat with great force. Generally, a relatively rigid inner core (e.g., 36 in FIG. 7) can extend along a length of the handle. This can provide sufficient rigidity to the handle so that a user can support his or her weight by grasping it. In one aspect, the handle is at least about eight inches in length to accommodate both hands of the user placed side-by-side on the handle.

In the example shown, the flexible line 18 is attached to and extends from only one end of the handle 20, with the opposing end of the handle being free to move relative to the flexible line. This is advantageous for a number of reasons. Firstly, this configuration allows a user to more easily and quickly release his or her grasp on the handle, thereby allowing the tether to retract into the relaxed configuration and be stored upon the boat.

In addition, the present inventor has found that configuring the tether in this manner results in the handle trailing behind the flexible line in substantially a straight line. The user, in order to securely grasp the handle, naturally places his or hands one behind the other on the handle in much the same way a "tug-of-war" participant would grasp a tug-of-war rope. When the surfer is grasping the tether in this manner, similar to that shown in FIG. 1, the surfer is naturally positioned in the proper stance for wake surfing. The surfer can then simply release the handle from both hands and begin wake surfing, already being properly positioned and without fear of the rope remaining in his or her vicinity. This can be very helpful for beginning surfers who may not be familiar with the proper stance and location, or those who struggle to release an ordinary tow rope.

Figure 4:
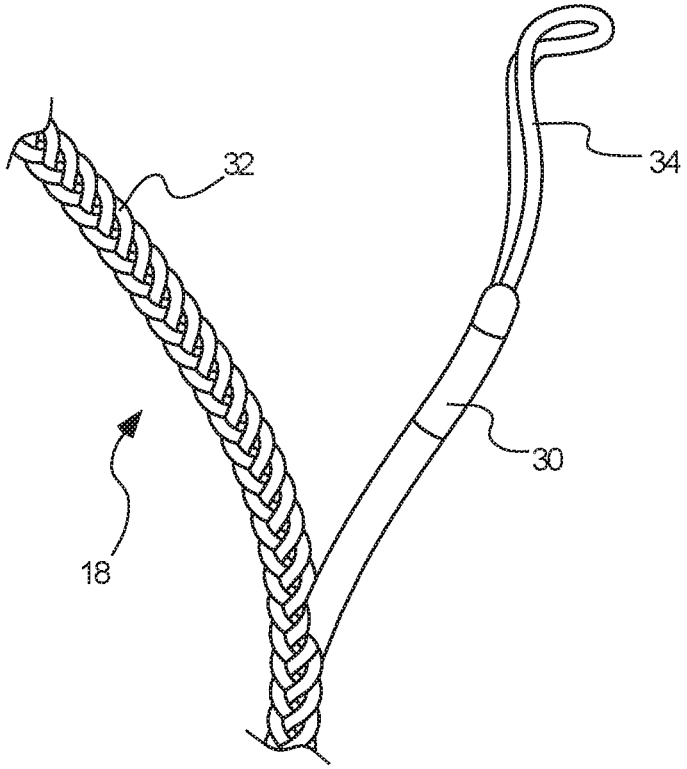
FIG. 4 is a sectional view of a flexible line of the tether, showing a portion of an elastic element extending through a wall of a limiter.

FIGS. 4 though 7 illustrate various components of one exemplary embodiment of the tether. In one aspect of the technology, the flexible line 18 can include at least one elastic member 30 and at least one limiter 32. The limiter can be operable to limit extension of the flexible line once in the taut configuration. The elastic member and the limiter can be adjustably coupled to one another to allow a user to adjust a restoring force in the tether when the tether is extended into the taut configuration. In this manner, a user of the tether can adjust the force at which the tether retracts into the relaxed configuration from the taut configuration.

In the example shown, the elastic member 30 can include a tubular elastic member, similar to the material commonly referred to as surgical tubing, in one example a latex rubber tubing with a 5/16 inch outer diameter and a 3/16 inner diameter (forming a wall thickness of 1/16 inch). This material can elastically extend a great distance and return to a nominal extension once no longer under load. The limiter 32 can be formed from a braided rope material, as referenced above. Thus, in one embodiment, the limiter and the elastic member are arranged in parallel with one another. The two can also be arranged serially, where advantageous.

In the arrangement shown, the limiter 32 at least partially circumscribes the elastic member 30 and a portion of the elastic member can extend through a wall of the limiter. Due to its braided construction, the limiter can include a plurality of openings formed in the wall of the limiter. The elastic member can include a loop 34 extending from an end thereof. This loop can extend through one of the plurality of openings formed in the wall of the limiter and can loop about or otherwise engage the limiter to prevent movement of the end of the elastic member relative to the limiter.

Figure 5:
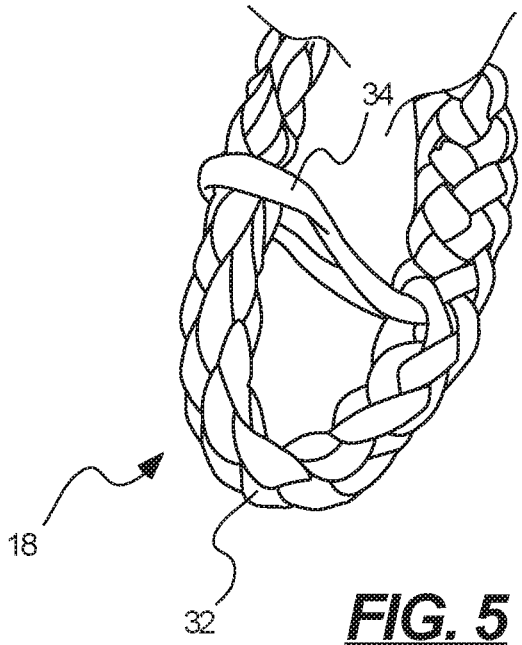
FIG. 5 is a sectional view of the flexible line, showing a loop extending from an end of the elastic element engaging a further portion of the limiter.
Figure 6:
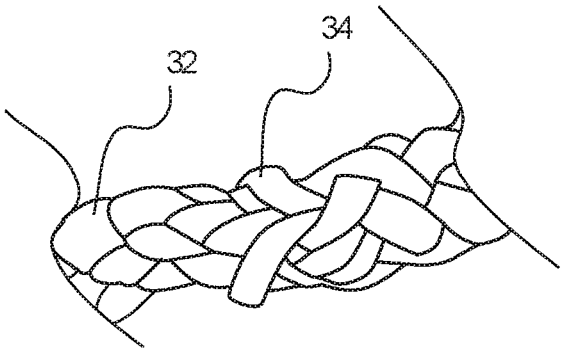
FIG. 6 is a sectional view of the loop of FIG. 5 fully engaging the limiter.

FIGS. 4 through 6 illustrate this relationship. In FIG. 4, the elastic member 30 can be inserted through a desired location in the wall of the limiter 32. This will be location at which the elastic member engages and applies force to the limiter. In FIG. 5, the limiter can be inserted through the loop or hook 34. In FIG. 6, the two are shown pulled taut relative to one another. Thus, it will be appreciated that applying a force to the limiter will result in the elastic member pulling back on the limiter. When the limiter is pulled to it maximum extension (e.g., when the tether is in the taut configuration shown in FIG. 1), the limit resists further extension, even in the case that the elastic member could extend much further. As the elastic member is pulled into tension at this point, a restoring force is created in the elastic member: releasing the limiter allows the elastic member to return the overall assembly to a neutral, or nominal condition with no restoring force present in the elastic member (e.g., when the tether is in the relaxed configuration of FIG. 1).

As the elastic member 30 and the limiter 32 can be relatively easily adjusted relative to one another, a user can easily adjust the restoring force stored in the tether 18 when the tether is pulled into the taut configuration. At extreme force loads (e.g., when the elastic member is stretched a great distance), the handle 20 can be propelled toward the watercraft 14 at very high speeds. This can possibly pose a danger that the boat will be damaged, or that someone on the boat may be injured. If the restoring force is too high, a user can very simply release the connection between the elastic member and the limiter and attach the elastic member at a location on the limiter closer to the boat. In this manner, the elastic member will stretch less as the tether is pulled into the taut condition, and the restoring force will be reduced. The opposite correction can be made if the restoring force is too little, possibly resulting in the handle not returning to the safety zone on or adjacent to the boat.

In the example shown in FIG. 2, hooks or loops 34 from the elastic member 30 (not visible in this view, as it is concealed by the limiter 32) can extend through the wall of the limiter in two places. In this manner, the relative position of the elastic member and the limiter can be adjusted in two locations—on each end of the elastic member. In other embodiments, the elastic member can be permanently fixed on one end to the limiter and only adjustable on the opposing end.

Figure 7:
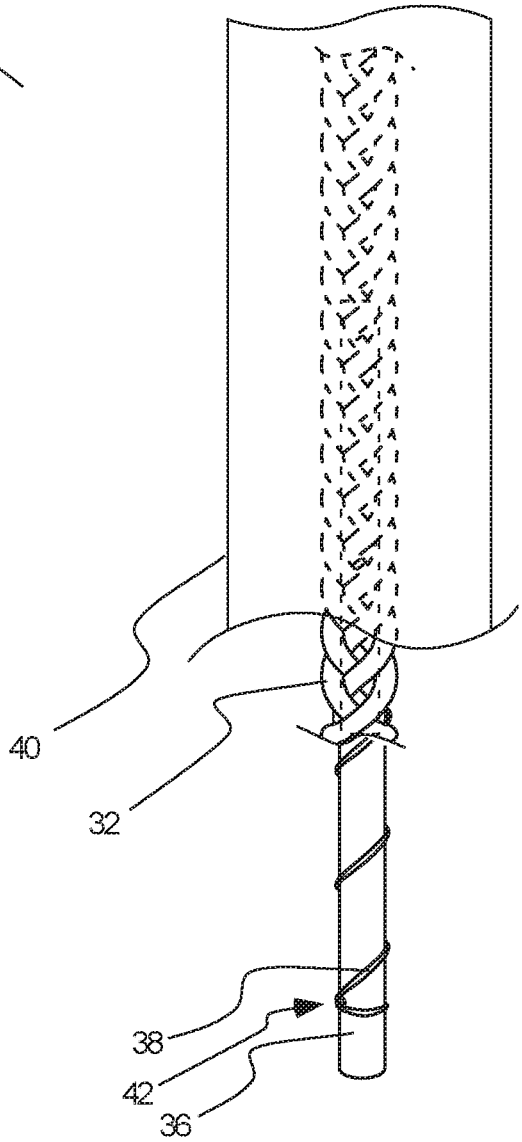
FIG. 7 is a partially sectioned view of the flexible line of the tether, showing various stages of attaching the flexible line to a section of the handle.

FIG. 7 illustrates one exemplary manner in which the limiter 32 (and thus the entire flexible line 18) can be attached to the handle 20. In this example, the construction can begin with a relatively solid core 36, which can be formed from a material such as a ½ inch diameter natural nylon rod. A hole 42 can be formed in the rod and a reinforcing material, such as a 16 gauge bailing wire 38 can be wound about the rod. The braided material of the limiter 32 can then be sheathed over the reinforcing material. An outer foam material 40 of the handle can then be applied about the entire handle assembly. In one example, a two-piece mold can be fitted about the handle, and liquid foam can be introduced into the mold and allowed to cure. As the foam material can be applied as a liquid, the liquid can infiltrate and fill interstitial openings in the braided material, and also envelope the reinforcing material. Once cured, a very solid bond is made with the foam material extending over the outer surface of the rod, around and under the wire and through the braided limiter. While not so required, in one aspect, the rope can extend over the entirety of the rod and a metal cinch (such as a length of bailing wire) can be applied over the braided rope at a location just beyond the end of the rod. The braided rope can be cut at this point and melted to create a welded joint beyond the cinch. This entire assembly can then be encased in the outer foam material, as discussed above. In this manner, the limiter is very securely attached to the rod.

In addition to the structure discussed above, the present technology also provides various methods for manufacturing a tether, using a tether, installing a tether, adjusting a tether, etc. In particular, the present technology provides a method for providing a user with a connection to a vehicle. The method can include obtaining a tether including a handle graspable by a user and a flexible line extending from the handle, the flexible line being elastically extendible from a relaxed configuration having a relaxed length to a taut configuration having a taut length, the taut length being greater than the relaxed length. The tether can be coupled to the vehicle at a location along the tether such that: when the tether is in the taut condition the handle is positioned in a grasping location remote from the vehicle for grasping by the user; and when the tether is in the relaxed configuration the tether does not extend beyond a safety boundary of the vehicle.

The flexible line can include at least one elastic member and at least one limiter adjustably coupled to one another, the limiter operable to limit extension of the flexible line once in the taut configuration. The method can further include adjusting at least one point at which the elastic member is coupled to the limiter to thereby adjust a restoring force in the tether when the tether is extended into the taut configuration.

The limiter can at least partially circumscribe the elastic member and a portion of the elastic member can extend through a wall of the limiter. Adjusting the at least one point at which the elastic member is coupled to the limiter can include adjusting a location at which the elastic member extends through the wall of the limiter. Adjusting the location at which the elastic member extends through the wall of the limiter can include removing the elastic member from one of the plurality of openings and inserting the elastic member through another of the plurality of openings.

The flexible line can extend from only one end of the handle, an opposing end of the handle being free to move relative to the flexible line. Coupling the tether to the vehicle can include coupling the tether to the vehicle such that the handle is positioned at a wake surfing location behind the vehicle. The handle can be at least about eight inches in length to accommodate both hands of the user placed side-by-side on the handle in a tug-of-war position in the wake surfing location behind the vehicle.

It is to be understood that the above-referenced arrangements are illustrative of the application for the principles of the present invention. Numerous modifications and alternative arrangements can be devised without departing from the spirit and scope of the present invention while the present invention has been shown in the drawings and described above in connection with the exemplary embodiments(s) of the invention. It will be apparent to those of ordinary skill in the art that numerous modifications can be made without departing from the principles and concepts of the invention as set forth in the examples.

I claim:

1. A safety tether for providing a user with a connection to a vehicle, the tether comprising:

a substantially rigid, elongate handle graspable by the user; and a flexible line extending from one end of the handle and being attachable to a vehicle, an opposing end of the handle being free to move relative to the flexible line;

the flexible line being elastically extendible from a relaxed configuration having a relaxed length to a taut configuration having a taut length, the taut length being greater than the relaxed length;

the flexible line including at least one elastic member and at least one limiter, the limiter operable to limit extension of the flexible line once in the taut configuration;

the elastic member and the limiter being adjustably coupled to one another to allow a user to adjust a restoring force in the tether when the tether is extended into the taut configuration;

the limiter at least partially circumscribing the elastic member and a portion of the elastic member extending through one of a plurality of openings formed in a lateral wall of the limiter.

2. The tether of claim 1, wherein the handle is at least about eight inches in length to accommodate both hands of the user placed side-by-side on the handle.

3. The tether of claim 1, wherein the limiter and the elastic member are arranged in parallel with one another.

4. The tether of claim 1, wherein the elastic member includes a loop extending from an end thereof, the loop extending through the one of the plurality of openings formed in the lateral wall of the limiter and engaging the limiter to prevent movement of the end of the elastic member relative to the limiter.

5. The safety tether of claim 1, wherein the limiter includes a braided rope having the plurality of openings formed in a lateral wall thereof.

6. A safety tether for providing a user with a connection to a vehicle, the tether comprising:

a handle, graspable by a user;

a flexible line extending from the handle, the flexible line being coupleable to a vehicle in a location remote from the handle;

the flexible line being elastically extendible from a relaxed configuration to a taut configuration;

the flexible line having at least one elastic member and at least one limiter, the limiter operable to limit extension of the flexible line once in the taut configuration;

the elastic member and the limiter being adjustably coupled to one another to allow a user to adjust a restoring force in the tether when the tether is extended into the taut configuration.

7. The tether of claim 6, wherein the limiter and the elastic member are arranged in parallel with one another.

8. The tether of claim 7, wherein the limiter at least partially circumscribes the elastic member and a portion of the elastic member extends through a wall of the limiter.

9. The tether of claim 8, further comprising a plurality of openings formed in the wall of the limiter, and wherein the elastic member includes a loop extending from an end thereof, the loop extending through the one of the plurality of openings formed in the wall of the limiter and engaging the limiter to prevent movement of the end of the elastic member relative to the limiter.

10. The tether of claim 9, wherein each end of the elastic member includes a loop extending therefrom, and wherein each loop extends through a different one of the plurality of openings formed in the wall of the limiter and engages the limiter to prevent movement of each of the ends of the elastic member relative to the limiter.

11. The tether of claim 6, wherein the flexible line extends from only one end of the handle, an opposing end of the handle being free to move relative to the flexible line.

12. The tether of claim 11, wherein the handle is at least about eight inches in length to accommodate both hands of the user placed side-by-side on the handle.

13. The safety tether of claim 6, wherein the limiter includes a braided rope having a plurality of openings formed in a lateral wall thereof.

14. A method for providing a user with a connection to a vehicle, the method comprising:

obtaining a tether including a handle graspable by a user and a flexible line extending from the handle, the flexible line being elastically extendible from a relaxed configuration having a relaxed length to a taut configuration having a taut length, the taut length being greater than the relaxed length;

coupling the tether to the vehicle at a location along the tether such that:

when the tether is in the taut condition the handle is positioned in a grasping location remote from the vehicle for grasping by the user; and when the tether is in the relaxed configuration the tether does not extend beyond a safety boundary of the vehicle.

15. The method of claim 14, wherein the flexible line includes at least one elastic member and at least one limiter adjustably coupled to one another, the limiter operable to limit extension of the flexible line once in the taut configuration, and wherein the method further comprises;

adjusting at least one point at which the elastic member is coupled to the limiter to thereby adjust a restoring force in the tether when the tether is extended into the taut configuration.

16. The method of claim 14, wherein the limiter and the elastic member are arranged in parallel with one another.

17. The method of claim 16, wherein the limiter at least partially circumscribes the elastic member and a portion of the elastic member extends through a wall of the limiter, and wherein adjusting the at least one point at which the elastic member is coupled to the limiter comprises adjusting a location at which the elastic member extends through the wall of the limiter.

18. The method of claim 17, wherein the wall of the limiter includes a plurality of openings formed therein, and wherein adjusting the location at which the elastic member extends through the wall of the limiter includes removing the elastic member from one of the plurality of openings and inserting the elastic member through another of the plurality of openings.

19. The method of claim 14, wherein the flexible line extends from only one end of the handle, an opposing end of the handle being free to move relative to the flexible line, and wherein coupling the tether to the vehicle includes coupling the tether to the vehicle such that the handle is positioned at a wake surfing location behind the vehicle.

20. The method of claim 19, wherein the handle is at least about eight inches in length to accommodate both hands of the user placed side-by-side on the handle in a tug-of-war position in the wake surfing location behind the vehicle.

21. A safety tether for providing a user with a connection to a vehicle, the tether comprising:

a substantially rigid, elongate handle graspable by the user;

a flexible line extending from one end of the handle and being attachable to a vehicle, an opposing end of the handle being free to move relative to the flexible line;

the flexible line being elastically extendible from a relaxed configuration having a relaxed length to a taut configuration having a taut length, the taut length being greater than the relaxed length;

wherein the flexible line includes at least one elastic member and at least one limiter arranged in parallel with each other, the limiter operable to limit extension of the flexible line once in the taut configuration;

the elastic member and the limiter being adjustably coupled to one another to allow a user to adjust a restoring force in the tether when the tether is extended into the taut configuration;

the limiter at least partially circumscribing the elastic member and a portion of the elastic member extending through a wall of the limiter; and a plurality of openings formed in the wall of the limiter, and wherein the elastic member includes a loop extending from an end thereof, the loop extending through one of the plurality of openings formed in the wall of the limiter and engaging the limiter to prevent movement of the end of the elastic member relative to the limiter.

* * * * *